US009788610B2

(12) United States Patent
Canei

(10) Patent No.: US 9,788,610 B2
(45) Date of Patent: Oct. 17, 2017

(54) FOOTWEAR, FOOTWEAR VAMP, FOOTWEAR VAMP FASTENING ELEMENT, FOOTWEAR-VAMP ASSEMBLY AND PROCESSES OF PRODUCTION AND/OR ASSEMBLY OF FOOTWEAR

(71) Applicant: Grendene S.A., Sobral (BR)

(72) Inventor: Ademir Canei, Farroupilha (BR)

(73) Assignee: Grendene S.A., Sobral (BR)

( * ) Notice: Subject to any disclaimer, the term of this patent is extended or adjusted under 35 U.S.C. 154(b) by 653 days.

(21) Appl. No.: 13/961,161

(22) Filed: Aug. 7, 2013

(65) Prior Publication Data

US 2014/0041255 A1 Feb. 13, 2014

(30) Foreign Application Priority Data

Aug. 8, 2012 (BR) ..... 102012019839

(51) Int. Cl.

*A43B 3/12* (2006.01)
*A43C 19/00* (2006.01)
*A43B 3/10* (2006.01)

(52) U.S. Cl.

CPC ..... *A43C 19/00* (2013.01); *A43B 3/103* (2013.01); *A43B 3/122* (2013.01)

(58) Field of Classification Search

CPC ..... A43B 3/103; A43B 3/122; A43B 3/244; A43C 3/00
USPC ..... 36/11.5, 100, 101
See application file for complete search history.

(56) References Cited

U.S. PATENT DOCUMENTS

| | | | | |
|---|---|---|---|---|
| 1,331,914 | A * | 2/1920 | Hall | A43C 3/00 24/712.2 |
| 2,368,314 | A * | 1/1945 | Herman | A43B 3/24 36/101 |
| 4,172,330 | A * | 10/1979 | Kao | A43B 3/103 36/101 |
| 5,896,684 | A | 4/1999 | Lin | |
| 6,418,643 | B1 * | 7/2002 | Yang | A43B 3/0078 36/101 |
| 8,171,654 | B2 * | 5/2012 | Rudd, Jr. | A43B 3/103 36/101 |
| 2002/0162202 | A1 * | 11/2002 | Kay | A43B 3/122 24/662 |

(Continued)

FOREIGN PATENT DOCUMENTS

| | | | |
|---|---|---|---|
| BR | 0306051-9 | A | 8/2005 |
| BR | 8800678-6 | U2 | 11/2010 |
| BR | PI0903677-6 | A2 | 6/2011 |

(Continued)

OTHER PUBLICATIONS

European Patent Office, European Search Report (on related application), dated Dec. 13, 2013.

*Primary Examiner* — Ted Kavanaugh
(74) *Attorney, Agent, or Firm* — Laurence P. Colton; Smith Tempel Blaha LLC

(57) ABSTRACT

A footwear, footwear vamp, footwear vamp fastening element, footwear-vamp assembly and processes for production and/or assembly of a footwear. A footwear (10) comprising at least one vamp (1), at least one outsole (6) and at least one fastening element (2), the fastening element (2) comprising at least one base (5) and at least one projection (4), defining a confinement region (7) for mounting the vamp (1.1).

10 Claims, 4 Drawing Sheets

(56) References Cited

U.S. PATENT DOCUMENTS

| | | | |
|---|---|---|---|
| 2011/0179671 | A1 | 7/2011 | Roth |

FOREIGN PATENT DOCUMENTS

| | | | |
|---|---|---|---|
| BR | 9000640-2 | U2 | 12/2011 |
| DE | 29808553 | U1 | 8/1998 |
| WO | 2006060038 | A2 | 6/2006 |
| WO | 2012044146 | A1 | 4/2012 |
| WO | 2012048370 | A1 | 4/2012 |

* cited by examiner

FOOTWEAR, FOOTWEAR VAMP, FOOTWEAR VAMP FASTENING ELEMENT, FOOTWEAR-VAMP ASSEMBLY AND PROCESSES OF PRODUCTION AND/OR ASSEMBLY OF FOOTWEAR

STATEMENT OF RELATED APPLICATIONS

This application claims the benefit of Brazilian Patent Application No. 10 2012 019839-8 having a filing date of 8 Aug. 2012.

BACKGROUND OF THE INVENTION

Field of the Invention

The present invention describes a footwear, a footwear vamp, a footwear vamp fastening element, a footwear-vamp assembly and a process for production and/or assembly of said footwear, the fastening of the vamp to the outsole being able to make the same exchangeable, in this way, ensuring easy replacement and possibility of customization of the footwear with different customized vamps, and, furthermore, allowing an extension of the footwear's lifetime. The present invention lies in the field of footwear and design industry.

Prior Art

The footwear is a piece of apparel having the primary function of protecting the feet from the environment. There is a great variety of footwear that is classified by their use and format. In some cases, socks are used along with footwear, both for protection and for the comfort of the feet. Depending on the culture and time, there are differentiations in footwear worn by men and women.

Additionally, the footwear can be worn as a means for social distinction, demonstrating wealth or political positioning of a person, while a few models are adorned with gemstones. In modern society, the final design (drawing) is dictated by the fashion industry.

In parallel, the constant increase in the variety of styles of clothes available in the market, intended for different occasions, makes it also necessary to have a great variety of shoes, in order to enable an appropriate combination with the clothes, according to the occasion and/or the model, color or style of the clothes chosen by the user.

In consequence to this situation, the user now has the need to have several different pairs of shoes, each one for a specific occasion/combination, having the inconvenience of needing to have a large space for housing the shoes and invest a high amount of money to buy different shoes, even if they end up being little worn and/or unwearable as a result of possible partial faults thereof, requiring the full exchange of footwear.

Such inconveniences are quite common, with respect to the sandals and other similar footwear, which comprise vamps, pipettes or the like associated with the outsole of footwear and, for these types of shoes, in general, the vamps, pipettes or the like are the first elements to suffer wear and/or rupture, forcing the user to replace the footwear as a whole.

In addition, the region of greatest visual prominence of footwear is defined by vamps, pipettes or the like and, thus, these have the main responsibility for providing the combination of footwear with the remaining items of clothing of the user. In this way, the need to acquire a high quantity of this type of footwear is closely related to the characteristics of vamps, pipettes, or the like, of the shoes.

With the purpose of seeking to address the above described disadvantages, a footwear becomes necessary, which allows the exchange of vamps, pipettes and/or the like, both to allow the same footwear to comprise different visuals, in accordance with the user's interest, and for seeking to prolong the lifetime thereof, further, such substitution being possible in a simplified and effective manner.

In the patent scope, some merely partially relevant documents were found, which are described below.

Document BRMU8800678-6 discloses an outsole provided with a fitting region able to allow the mounting of the ends of a vamp, which are fixed to the outsole after their displacement to a fastening region, allowing the replacement of the vamp in slippers, sandals and the like. Said fitting, however, shows a very cumbersome installation for the user, who needs to adjust the ends in an ideal position for operation in order to prevent the vamp from escaping the outsole when wearing the footwear. Additionally, when wearing the footwear, the vamp tends to move, causing the displacement of the ends, causing the vamp to escape and discomfort to the user. The present invention differs from this document by the fact that the end of the vamp is shaped to operate cooperatively with a fitting element, associated with the vamp, conferring a simple fastening with enough rigidity to ensure the fastening of the vamp to the outsole, even when wearing the footwear.

Document BRPI0306051-9 discloses a device for fixing a sandal vamp, through the mounting of its ends to a clip element, fixed through a threaded element. Although seemingly rigid, the vamp mounting proposed by document BRPI0306051-9 is very cumbersome for the user, especially with respect to passing the ends though the outsole openings. Furthermore, the cost of manufacturing the clips and threaded element are relatively high, because they demand a certain degree of precision and materials having the rigidity required for supporting the efforts of wearing the footwear. The present invention differs from this document by the fact that the end of the vamp is shaped to operate cooperatively with a fitting element, associated with the vamp, conferring a simple fastening with enough rigidity to ensure the fastening of the vamp to the outsole, even when wearing the footwear and having low cost of manufacturing, due to the simplicity of the parts involved.

Document BRMU0903677-6 discloses a sandal vamp modified for fixing to a footwear outsole, through bending and fitting its ends at the lower region of the outsole. The ends of the vamps comprise holes able to associate in projections at the lower region of the outsole. The fixing of the vamps according to document BRMU0903677-6 presents the drawback of not conferring a fastening that is effective for every possible demand of the shoe, since the detachment of the vamp may occur at any outsole fastening on a ground obstacle. The present invention differs from this document by the fact that the end of the vamp is shaped to operate cooperatively with a fitting element, associated with the vamp, conferring a simple fastening with enough rigidity to ensure the fastening of the vamp to the outsole, even when wearing the footwear and having low cost of manufacturing, due to the simplicity of the parts involved.

Document BRMU9000640-2 discloses a sandal vamp with ends associated with mobile parts provided with radial recesses, allowing them to encompass the vamp ends. The mounting region between the vamp ends and the mobile parts comprise compatible internal and external geometric characteristics. The sandal vamp described in document BRMU9000640-2 confers the fastening of the mobile parts only toward the ground, since they are supported at the geometry of the vamp ends, enabling the accidental disengagement of the vamp from the outsole, in case the end is forced downward. The present invention differs from this document by the fact that the end of the vamp is shaped to operate cooperatively with a fitting element, associated with the vamp, conferring a simple fastening with enough rigidity to ensure the fastening of the vamp to the outsole in many directions, even when wearing the footwear and having low cost of manufacturing, due to the simplicity of the parts involved.

It is noted, however, that some sandals and similar footwear already enable the attachment and detachment of their vamps or equivalent elements from the outsole, however, all of the solutions are overly cumbersome for the user, do not confer the rigidity required for using the footwear, and/or represent a high cost of manufacture.

From what is clear from the searched literature, no documents were found anticipating or suggesting the teachings of the present invention, so that the solution proposed herein has novelty and inventive step in view of the prior art.

BRIEF SUMMARY OF THE INVENTION

The present invention discloses a novel footwear, footwear vamp, footwear vamp fastening element, footwear-vamp assembly and processes for production and/or assembly of a footwear.

Therefore, a first object of the present invention is a footwear (10) comprising at least one vamp (1), at least one outsole (6) and at least one fastening element (2), the fastening element (2) comprising at least one base (5) and at least one projection (4), defining a confinement region (7) for mounting the vamp (1.1).

A second object of the present invention is a vamp (1) for a footwear (10) comprising at least one vamp (1), at least one outsole (6) and at least one fastening element (2), the vamp (1) being able to associate cooperatively with the fastening element (2), which comprises at least one base (5) and at least one projection (4) defining one confinement region (7) of the mounting region of the vamp (1.1).

A third object of the present invention is a fastening element (2) to a footwear (10) comprising at least one vamp (1), at least one outsole (6) and at least one fastening element (2), the fastening element (2) comprising at least one base (5) and at least one projection (4), defining a confinement region (7) for the mounting region of the vamp (1.1).

A fourth object of the present invention is a footwear-vamp assembly defined by a footwear (10) comprising at least one vamp (1), at least one outsole (6) and at least one fastening element (2), the fastening element (2) comprising at least one base (5) and at least one projection (4), defining a confinement region (5) for mounting the vamp (1.1).

In a preferred embodiment, the projection (4) comprises a first portion (4.1) fixed to the base (5) of the fastening element (2) and a second end (4.2) in balance.

In a preferred embodiment, the vamp (1) is provided with a geometry able to house the projection (4) of the fastening element (2), in such a way that a mounting region of the vamp (1.1) is confined between the base (5) and the projection (4) of the fastening element (2), defining the confinement region (7).

In a preferred embodiment, the outsole (6) comprises a plurality of housings (8) for mounting the vamps (1).

In a preferred embodiment, the footwear (10) is a slipper, a sandal, or the like.

A fifth object of the present invention is a process for the production and/or assembly of footwear, comprising the steps of: placing the assembly portions (3) of the vamp (1) in the housings (8) of the outsole (6); and inserting the projections (4) in the openings (1.2) of the vamp (1).

These and other objects of the invention shall be immediately appreciated by persons skilled in the art and by companies with interests in the segment, and will be described in sufficient detail for its reproduction in the following description.

DETAILED DESCRIPTION OF PREFERRED EMBODIMENTS

Figure 1:
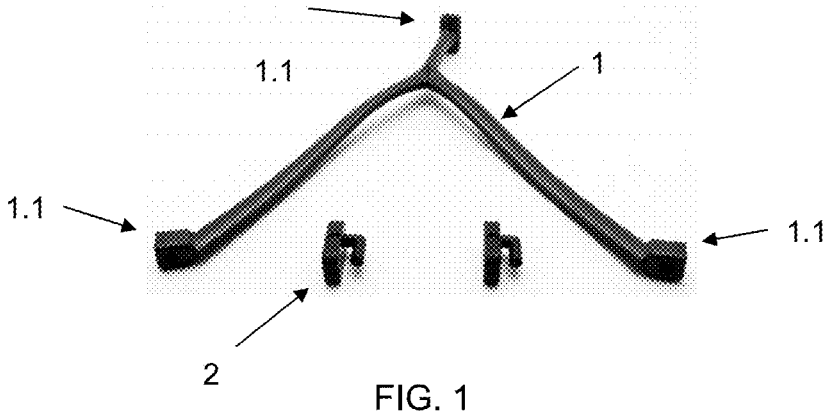
FIG. 1 shows the vamp (1) and the fastening element (2).
Figure 2:
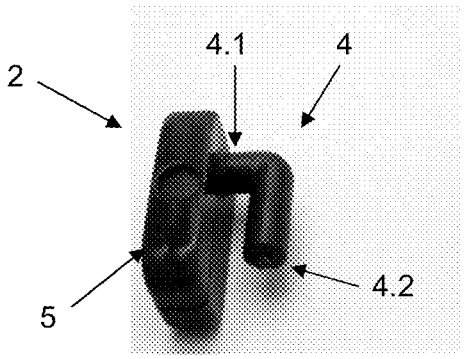
FIG. 2 shows, in detail, the fastening element (2) with the base (5) and the first portion (4.1) and the second portion (4.2) of the projection (4).
Figure 3:
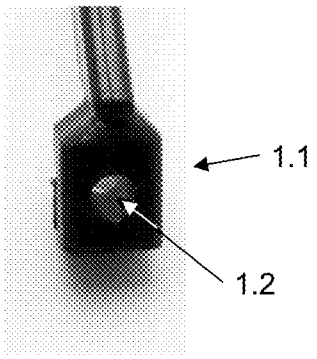
FIG. 3 shows, in detail, the assembly region (1.1) of the vamp (1), revealing the opening (1.2) for mounting the projection (4) of the fastening element (2).
Figure 4:
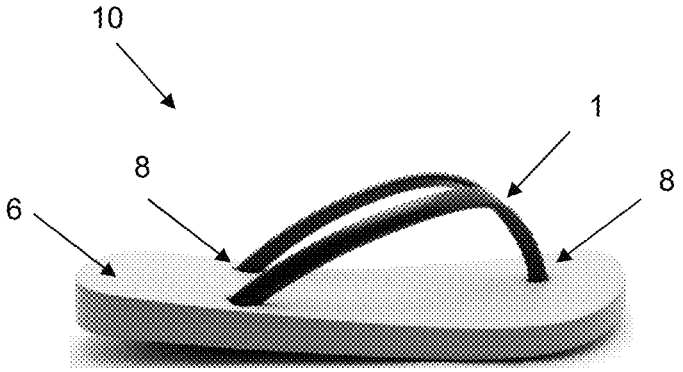
FIG. 4 shows a preferred embodiment of a footwear (10) comprising an outsole (6) and a vamp (1) mounted according to the present invention.
Figure 5:
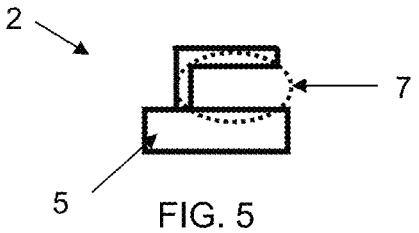
FIG. 5 shows a variation expected for the fastening element (2), revealing the confinement region (7).
Figure 6:
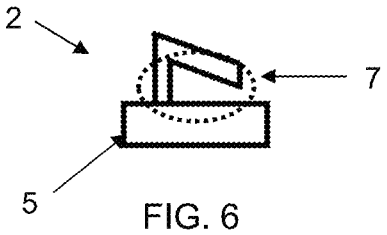
FIG. 6 shows a variation expected for the fastening element (2), revealing the confinement region (7).
Figure 7:
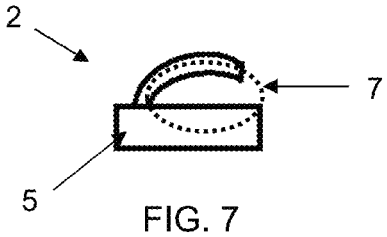
FIG. 7 shows a variation expected for the fastening element (2), revealing the confinement region (7).
Figure 8:
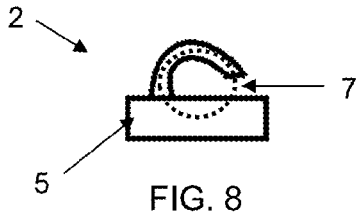
FIG. 8 shows a variation expected for the fastening element (2), revealing the confinement region (7).
Figure 9A:
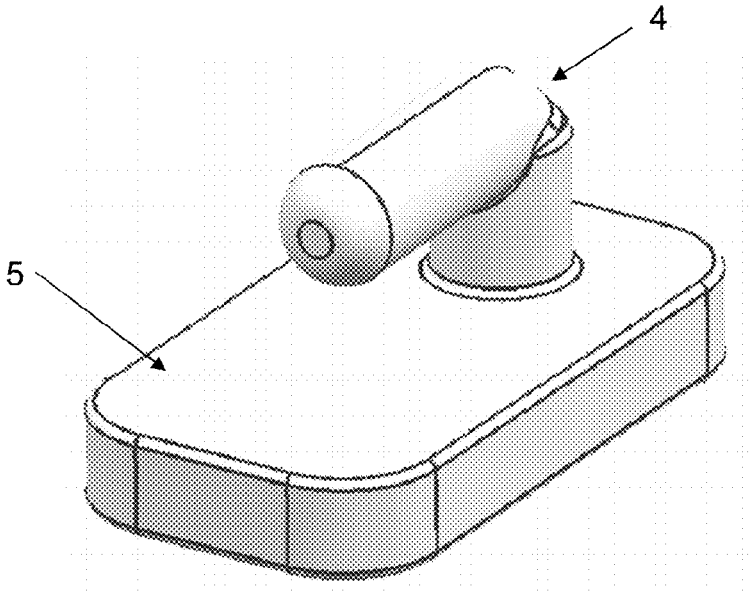
FIG. 9A shows a perspective view.
Figure 9B:
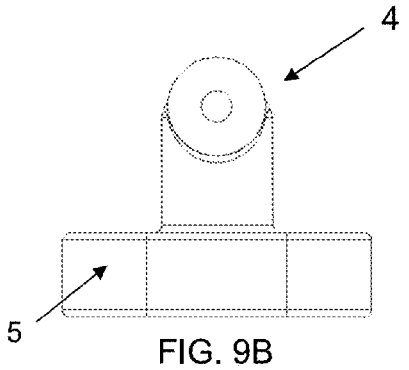
FIG. 9B shows a front view.
Figure 9C:
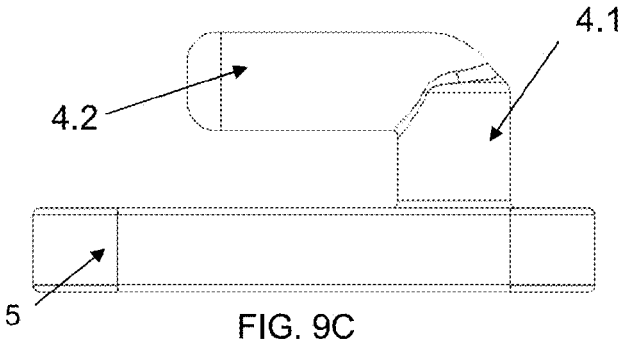
FIG. 9C shows a left side view of the fastening element (2) with the base (5) and the first portion (4.1) and the second portion (4.2) of the projection (4).
Figure 10A:
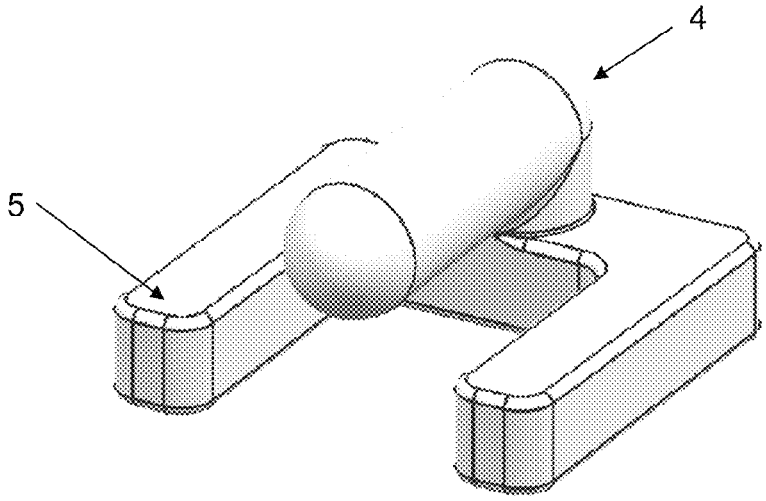
FIG. 10A shows a perspective view.
Figure 10B:
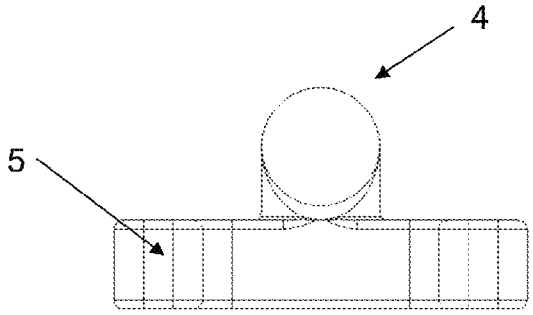
FIG. 10B shows a front view.
Figure 10C:
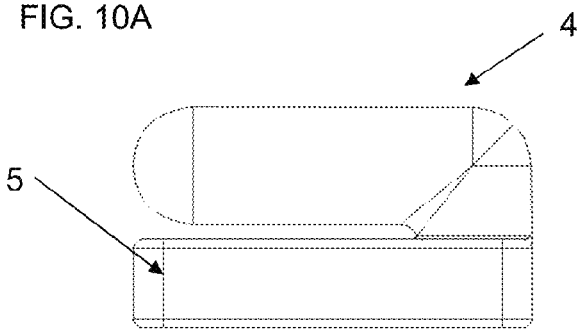
FIG. 10C shows a left side view of a variation expected for the fastening element (2).

The examples shown herein are only intended to exemplify one of the countless ways to carry out the invention, but without limiting the scope thereof.

The present invention comprises a footwear, a footwear vamp, a footwear vamp fastening element, a footwear-vamp assembly and processes for the production and/or assembly of footwear, the footwear being basically defined by the association of the vamp to an outsole.

The vamp, leather, or the like, typically comprises a fork-shaped geometry, which involves the foot with the outsole. The vamp, in general, is mounted to the outsole in a permanent manner, consolidating the two parts into a single body.

The present invention, however, presents the possibility of exchanging the vamp with different compatible soles and/or exchanging different vamps on a same outsole, with the intention of the outsole or vamp, in the case of wear or breakage of one of these parts, prolonging the lifetime of the footwear. A further possibility resides in the question of mere aesthetics, where replacement of the outsole and/or vamp occurs only with the purpose of obtaining a desired combination of footwear with the apparel worn.

Referring to the figures, in the present invention, it is provided a footwear 10 comprising preferably a vamp 1 associated, preferably, to an outsole 6.

Preferably, the vamp 1 is provided with a fork-shaped geometry, however, the use of different vamp geometries 1, as well as the use of a plurality of vamps 1 having different geometries, is provided by the present invention.

Additionally, in a preferred embodiment, only one outsole 6 is used, however, the use of a plurality of outsoles 6 being associated with the vamps 1, defining the footwear 10, is provided.

The vamps 1 are attached to the outsole 6 by a plurality of housings 8 and the fixing of the vamp 1 to the outsole 6 is given by at least one fastening element 2. Preferably, for a vamp 1 having fork-shaped geometry, the outsole 6 is provided with three housings 8, each allowing the mounting of a mounting portion 1.1 of the vamp 1.

The mounting regions 1.1 of the vamp 1 are arranged in the interior of the housings 8 of the outsole 6, arranging the part of the vamp 1 that contacts the feet of the user on the upper part of the outsole 6 and arranging the mounting regions 1.1 of the vamp at the lower part of the outsole 6.

The fastening element 2, in a preferred embodiment, comprises a base 5 and a projection 4. It should be noted, however, that different geometries can be obtained, providing more than one base 5 and/or more than one projection 4 to the fastening element 2, without interfering in the scope of the invention.

The projection 4 comprises a first portion 4.1 attached to the base 5 of the fastening element 2 and a second end 4.2 in balance, the projection 4 being provided with different geometries, such as "L", "C", "V" or any other geometry that comprises a first portion 4.1 attached to the base 5 and a second portion 4.2 in balance and that enables the mounting of the projection 4 in the interior of an opening 1.2 of the mounting region 1.1 of the vamp 1.

In this way, the region formed between the base 5 and the projection 4 defines a confinement region 7, where a mounting region of the vamp 1.1 is attached, configuring the association between the vamp 1 and the fastening element 2.

The opening 1.2 may be provided with any geometry capable of conferring an effective association with the projection 4 of the fastening element 2 and, further, the cross-section of the opening 1.2, is preferably substantially equal to the geometry of the cross section of the projection 4.

The present invention makes reference, further, to a process for the production and/or assembly of footwear, comprising the steps of: placing the assembly portions 3 of the vamp 1 in the housings 8 of the outsole 6; and inserting the projections 4 in the openings 1.2 of the vamp 1.

What is claimed is:

1. A footwear (10), comprising:

at least one vamp (1) comprising at least one mounting region (1.1) of the vamp (1), which comprises at least one opening (1.2) having an interior;

at least one outsole (6) comprising at least one housing (8) having an interior, wherein the at least one mounting region (1.1) of the at least one vamp (1) is arranged in the interior of the at least one housing (8) at a lower part of the at least one outsole (6); and at least one fastening element (2) comprising at least one base (5) and at least one projection (4), defining a confinement region (7) for mounting to the at least one opening of the vamp (1), wherein the at least one projection (4) comprises a first portion (4.1) fixed to the at least one base (5) of the at least one fastening element (2) and a cantilever second portion (4.2) fixed in a perpendicular manner to the first portion (4.1), wherein the cantilever second portion (4.2) is fixed in the interior of the at least one opening (1.2) of the mounting region (1.1) of the vamp (1), and wherein the cantilever second portion (4.2) has a cross-sectional geometry and the opening (1.2) has a cross-section having a geometry that corresponds to the cross-sectional geometry of the cantilever second portion (4.2).

2. The footwear according to claim 1, wherein the at least one outsole (6) comprises a plurality of the at least one housing (8) for mounting the at least one vamp (1).

3. The footwear according to claim 1, wherein the at least one vamp (1), the at least one outsole (6), and the at least one fastening element (2) are detachable of each other.

4. The footwear according to claim 1, wherein the at least one projection (4) of the at least one fastening element (2) is fitted inwardly in the at least one opening (1.2) of the at least one vamp (1), wherein the arranging of the mounting region (1.1) of the at least one vamp (1) at the lower part of the at least one outsole (6) cooperatively with the inward fitting of the at least one projection (4) of the at least one fastening element (2) in the at least one opening (1.2) of the at least one vamp (1) restrain an axial force provided by feet of a user in the at least one vamp (1) preventing axial movement of the at least one mounting region (1.1) of the at least one vamp (1) out of the at least one housing (8) and through the at least one outsole (6).

5. The footwear according to claim 4, wherein the at least one opening (1.2) is transversely oriented in relation to the direction of insertion of the at least one vamp (1) in the at least one housing (8) of the at least one outsole (6).

6. The footwear according to claim 1, wherein the at least one projection (4) of the at least one fastening element (2) is fitted inwardly in the at least one opening (1.2) of the at least one vamp (1), wherein the at least one opening (1.2) is transversely oriented in relation to the direction of insertion of the at least one vamp (1) in the at least one housing (8) of the at least one outsole (6).

7. The footwear according to claim 6, wherein the at least one vamp (1), the at least one outsole (6), and the at least one fastening element (2) are detachable of each other.

8. The footwear according to claim 1, wherein the at least one projection (4) of the at least one fastening element (2) is fitted inwardly in the at least one opening (1.2) of the at least one vamp (1), wherein the arranging of the at least one mounting region (1.1) of the at least one vamp (1) at the lower part of the at least one outsole (6) cooperatively with the inward fitting of the at least one projection (4) of the at least one fastening element (2) in the at least one opening (1.2) of the at least one vamp (1) restrain an axial force provided by feet of a user in the at least one vamp (1) preventing axial movement of the at least one mounting region (1.1) of the at least one vamp (1) out of the at least one housing (8) and through the at least one outsole (6).

9. The footwear according to claim 8, wherein the at least one opening (1.2) is transversely oriented in relation to the direction of insertion of the at least one vamp (1) in the at least one housing (8) of the at least one outsole (6).

10. A footwear-vamp assembly, comprising at least one footwear (10), which comprises:

at least one vamp (1) comprising at least one mounting region (1.1) of the at least one vamp (1), which comprises at least one opening (1.2) having an interior;

at least one outsole (6) comprising at least one housing (8) having an interior, wherein the at least one mounting region (1.1) of the at least one vamp (1) is arranged in the interior of the at least one housing (8) at a lower part of the at least one outsole (6); and at least one fastening element (2) comprising at least one base (5) and at least one projection (4), comprising a first portion (4.1) fixed to the at least one base (5), and a cantilever second portion (4.2) fixed in a perpendicular manner to the first portion, defining a confinement region (7) for mounting the at least one vamp (1);

wherein the cantilever second portion (4.2) is fixed in the interior of the at least one opening (1.2) of the at least one mounting region (1.1) of the at least one vamp (1), and wherein the cantilever second portion (4.2) has a cross-sectional geometry and the opening (1.2) has a cross-section having a geometry that corresponds to the cross-sectional geometry of the cantilever second portion (4.2).

* * * * *